US010444681B2

(12) United States Patent
Ogura et al.

(10) Patent No.: US 10,444,681 B2
(45) Date of Patent: Oct. 15, 2019

(54) IMAGE HEATING DEVICE AND HEATER USED FOR IMAGE HEATING DEVICE

(71) Applicant: CANON KABUSHIKI KAISHA, Tokyo (JP)

(72) Inventors: Ryota Ogura, Numazu (JP); Kazushi Nishikata, Tokyo (JP); Masato Hisano, Yokohama (JP); Fumiki Inui, Mishima (JP); Kazuhide Kudo, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 283 days.

(21) Appl. No.: 15/258,911

(22) Filed: Sep. 7, 2016

(65) Prior Publication Data

US 2017/0075268 A1 Mar. 16, 2017

(30) Foreign Application Priority Data

Sep. 11, 2015 (JP) ..... 2015-179568
Jul. 13, 2016 (JP) ..... 2016-138756

(51) Int. Cl.
*G03G 15/20* (2006.01)
*H05B 3/03* (2006.01)
*H05B 3/10* (2006.01)

(52) U.S. Cl.
CPC ..... *G03G 15/2053* (2013.01)

(58) Field of Classification Search
None
See application file for complete search history.

(56) References Cited

U.S. PATENT DOCUMENTS

| | | | |
|---|---|---|---|
| 6,423,941 | B1 | 7/2002 | Kanari et al. |
| 8,471,178 | B2 | 6/2013 | Taniguchi et al. |
| 8,552,342 | B2 | 10/2013 | Sakakibara et al. |
| 8,592,726 | B2 | 11/2013 | Tsuruya et al. |
| 9,095,003 | B2 | 7/2015 | Sakakibara et al. |
| 9,098,035 | B2 | 8/2015 | Nakahara et al. |
| 9,445,457 | B2 | 9/2016 | Sakakibara et al. |
| 9,494,899 | B2 | 11/2016 | Nakahara et al. |
| 2011/0062140 | A1 | 3/2011 | Sakakibara et al. |
| 2012/0121306 | A1 | 5/2012 | Shimura et al. |
| 2012/0201581 | A1 | 8/2012 | Shimura et al. |
| 2012/0201582 | A1 | 8/2012 | Shimura et al. |

(Continued)

FOREIGN PATENT DOCUMENTS

| | | | |
|---|---|---|---|
| JP | 2001-43956 | A | 2/2001 |
| JP | 2006-147274 | A | 6/2006 |

(Continued)

*Primary Examiner* — Joseph M Pelham
(74) *Attorney, Agent, or Firm* — Canon U.S.A., Inc. IP Division

(57) ABSTRACT

A heater of the invention includes a substrate; a first conductive element and a second conductive element which are provided on the substrate along a longitudinal direction of the substrate; a heat generating element which is provided between the first conductive element and the second conductive element and generates heat with power supplied via the first conductive element and the second conductive element; and an electrode to which a conductive member for supplying power is connected, in which a heat generation amount of a region corresponding to a position at which an electrode of the heat generating element is provided is set to be greater than a heat generation amount of other regions.

4 Claims, 7 Drawing Sheets

(56) References Cited

U.S. PATENT DOCUMENTS

| | | | |
|---|---|---|---|
| 2012/0308280 | A1 | 12/2012 | Tsuruya et al. |
| 2013/0209125 | A1 | 8/2013 | Uchitani |
| 2013/0251428 | A1 | 9/2013 | Ueno et al. |
| 2013/0299480 | A1 | 11/2013 | Kakubari et al. |
| 2013/0343790 | A1 | 12/2013 | Shimura et al. |
| 2013/0343791 | A1 | 12/2013 | Shimura et al. |
| 2014/0003848 | A1 | 1/2014 | Sakakibara et al. |
| 2014/0076878 | A1 | 3/2014 | Shimura et al. |
| 2014/0169845 | A1 | 6/2014 | Nakahara et al. |
| 2015/0289317 | A1 | 10/2015 | Sakakibara et al. |
| 2015/0293483 | A1 | 10/2015 | Nakahara et al. |

FOREIGN PATENT DOCUMENTS

| | | | |
|---|---|---|---|
| JP | 2010-054846 | A | 3/2010 |
| JP | 2011-069880 | A | 4/2011 |
| JP | 2011-151003 | A | 8/2011 |
| JP | 2014-59508 | A | 4/2014 |
| JP | 2014-139660 | A | 7/2014 |
| JP | 2014-153480 | A | 8/2014 |
| JP | 2015-194713 | A | 11/2015 |

IMAGE HEATING DEVICE AND HEATER USED FOR IMAGE HEATING DEVICE

BACKGROUND OF THE INVENTION

Field of the Invention

The invention relates to an image heating device such as a fixing unit mounted in an image forming apparatus of an electrophotographic recording type, such as a copier or a printer, or a glossing device for improving a toner image in gloss by heating a fixed toner image on a recording material again. The invention also relates to a heater used for the image heating device.

Description of the Related Art

As an image heating device, there is a device having a cylindrical film, a heater in contact with an inner surface of the film, and a roller forming a nip portion via the film together with the heater. When an image forming apparatus provided with such an image heating device performs continuous printing using small-sized paper, a phenomenon occurs in which temperature of a region through which the paper does not pass in a longitudinal direction of the nip portion gently increases (temperature rise in a sheet non-passing portion). If the temperature of the sheet non-passing portion becomes too high, individual parts in the device may be damaged, or if printing is performed by using large-sized paper while the temperature rise in the sheet non-passing portion is generated, high-temperature offset of toner may occur to the film in a region corresponding to the sheet non-passing portion of the small-sized paper.

As one of methods for suppressing such a temperature rise in the sheet non-passing portion, a device which switches heat generation distribution of a heater according to a size of a recording material by dividing a heat generating resistor on the heater into a plurality of groups (heat generating blocks) in a longitudinal direction of the heater is proposed (Japanese Patent Laid-Open No. 2014-59508).

Meanwhile, a conductive member for supplying power is connected to the heater, and temperature distribution of the heater is considered to be non-uniform due to heat radiation from the conductive member and an electrode to which the conductive member is connected.

SUMMARY OF THE INVENTION

In one embodiment, the invention provides a heater and an image heating device that prevent non-uniformity of temperature distribution.

One aspect of the invention is to provide a heater including: a substrate, a first conductive element provided on the substrate along a longitudinal direction of the substrate, a second conductive element provided at a position different from that of the first conductive element of the substrate in a widthwise direction of the substrate, a heat generating element which is provided between the first conductive element and the second conductive element and generates heat with power supplied via the first conductive element and the second conductive element, and an electrode to which a conductive member for supplying power to the heat generating element is connected, in which a heat generation amount of a region corresponding to a position at which the electrode of the heat generating element is provided is set to be greater than a heat generation amount of other regions, and an image heating device including the heater.

Another aspect of the invention is to provide an image heating device, including: a cylindrical film, and a heater in contact with an inner surface of the film, wherein an image formed on a recording material is heated with heat of the heater via the film, in which the heater has a substrate, and first to fourth heat generating blocks which are formed on the substrate at mutually different positions in a longitudinal direction of the heater, in which the first to fourth heat generating blocks are arranged in this order along the longitudinal direction, in which the device further includes a first driving element for driving the second heat generating block and the third heat generating block, a second driving element for driving the first heat generating block and the fourth heat generating block, a first temperature detecting element for detecting temperature of the second heat generating block, and a second temperature detecting element for detecting temperature of the fourth heat generating block, and in which neither the first heat generating block nor the third generating block is provided with a temperature detecting element.

Further features of the present invention will become apparent from the following description of exemplary embodiments with reference to the attached drawings.

DESCRIPTION OF THE EMBODIMENTS (Exemplary Embodiment 1)

Figure 1:
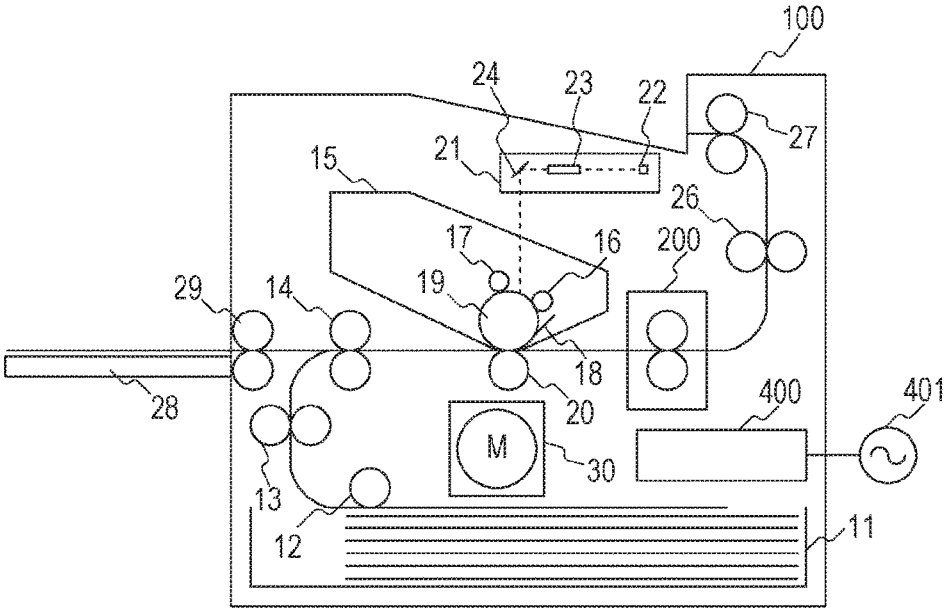
FIG. 1 is a cross-sectional view of an image forming apparatus.

FIG. 1 is a cross-sectional view of a laser printer (image forming apparatus) 100 using an electrophotographic recording technique. When a print signal generates, a scanner unit 21 emits laser beam modulated depending on image information, and scans a photosensitive member 19 which is charged to a predetermined polarity by a charging roller 16. As a result, an electrostatic latent image is formed on the photosensitive member 19. Toner is supplied to this electrostatic latent image from a developing device 17, so that a toner image depending on the image information is formed on the photosensitive member 19. On the other hand, recording sheets (recording material) P stacked in a sheet supplying cassette 11 are fed one by one by a pick-up roller 12, and then is conveyed toward a registration roller pair 14 by a roller pair 13. Further, the recording sheet P is conveyed to a transfer position from the registration roller pair 14 in synchronism with timing when the toner image on the photosensitive member 19 reaches a transfer position formed between the photosensitive member 19 and a transfer roller 20. In a process in which the recording sheet P passes through the transfer position, the toner image on the photosensitive member 19 is transferred onto the recording sheet P. Thereafter, the recording sheet P is heated by an image heating device (fixing device) 200, so that the toner image is heat-fixed on the recording sheet P. The recording sheet P bearing the fixed toner image is discharged onto a tray at an upper portion of the laser printer 100 by rollers 26 and 27. The reference numeral 18 denotes a cleaner for cleaning the photosensitive member 19, and the reference numeral 28 denotes a sheet feed tray (manual feed tray) having a pair of recording sheet regulating plates, a width of which is able to be adjusted according to a size of the recording sheet P. The sheet feed tray 28 is provided for handling also the recording sheet P of a size other than the standard size. The reference numeral 29 denotes a pick-up roller pair for feeding the recording sheet P from the sheet feed tray 28, and the reference numeral 30 denotes a motor for driving the image heating device 200 and the like. Power is supplied from a control circuit 400 connected to a commercial alternating current power supply 401 to the image heating device 200. The photosensitive member 19, the charging roller 16, the scanner unit 21, the developing device 17, and the transfer roller 20 which are described above constitute an image forming unit which forms an unfixed image onto the recording sheet P.

The laser printer 100 of the present exemplary embodiment can handle a plurality of sizes of recording sheets. In the sheet supplying cassette 11, Letter paper (approximately 216 mm×279 mm), Legal paper (approximately 216 mm×356 mm), A4 paper (210 mm×297 mm), and Executive paper (approximately 184 mm×267 mm) are able to be set. Further, JIS B5 paper (182 mm×257 mm) and A5 paper (148 mm×210 mm) are also to be set.

In addition, the laser printer 100 is able to perform printing on non-standard-sized paper such as a DL envelope (110 mm×220 mm) or a COM10 envelope (approximately 105 mm×241 mm) by feeding the non-standard-sized paper from the sheet feed tray 28. The laser printer 100 of the present exemplary embodiment basically feeds a sheet by short edge feeding (conveys a sheet so that a long side is parallel to a conveying direction). The recording sheets P having the largest (widest) width among standard-sized recording sheets P (recording sheets with width listed in a catalogue) that the device can handle are Letter paper and Legal paper which are approximately 216 mm in width. The recording sheet P having a smaller width than a maximum size that the laser printer 100 can handle is defined as small-sized paper in the present exemplary embodiment.

Figure 2:
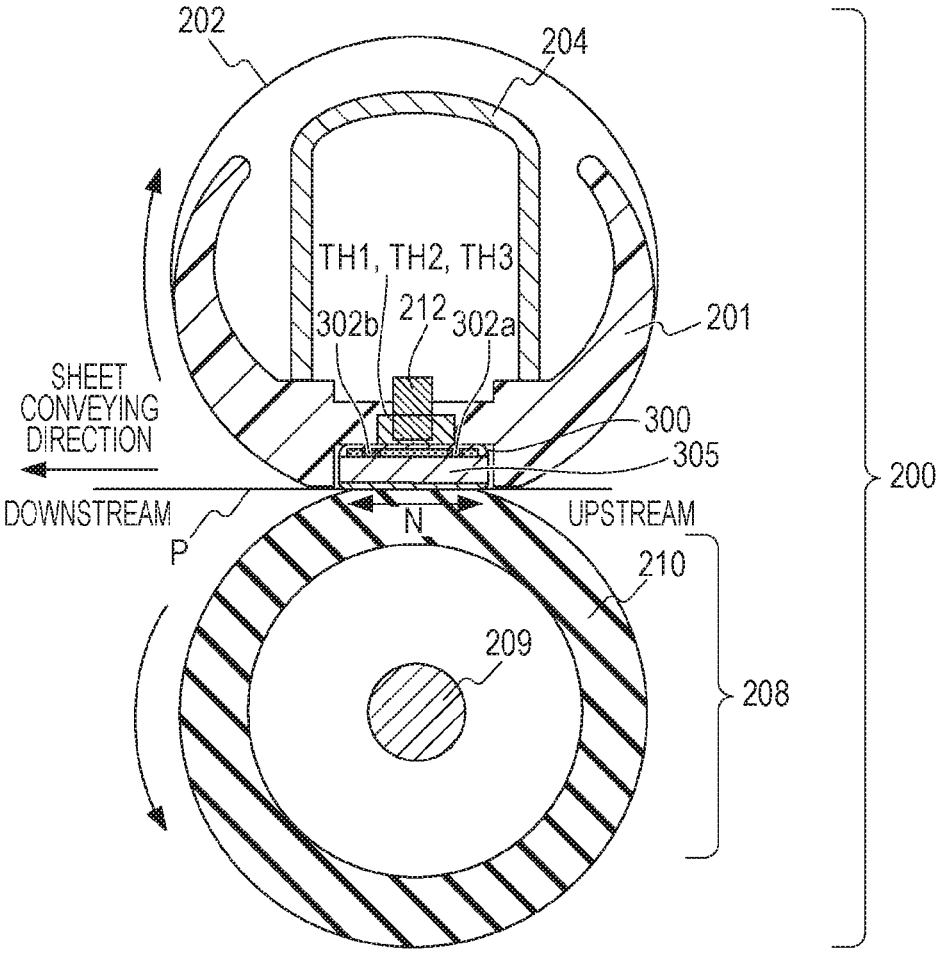
FIG. 2 is a cross-sectional view of an image heating device according to an exemplary embodiment 1.

FIG. 2 is a cross-sectional view of the image heating device 200. The image heating device 200 has a cylindrical film 202, a heater 300 in contact with an inner surface of the film 202, and a pressing roller (nip portion forming member) 208 forming a fixing nip portion N via the film 202 together with the heater 300. A material of a base layer of the film 202 is a heat-resistant resin such as polyimide or a metal such as stainless steel. An elastic layer such as heat-resistant rubber may be provided on a surface layer of the film 202. The pressing roller 208 has a core metal 209 made of a material such as iron or aluminum and an elastic layer 210 made of a material such as silicone rubber. The heater 300 is held by a holding member 201 which is made of a heat resistant resin. The holding member 201 also has a guiding function for guiding rotation of the film 202. The reference numeral 204 denotes a metal stay for exerting pressure of a spring (not illustrated) on the holding member 201. When receiving power from a motor 30, the pressing roller 208 rotates in a direction of an arrow. The film 202 rotates following the rotation of the pressing roller 208. The recording sheet P bearing an unfixed toner image is nipped and conveyed while being heated at the fixing nip portion N, and thereby the unfixed toner image is fixed.

The heater 300 is heated by heat generating resistors 302*a* and 302*b* provided on a ceramic substrate 305 described below. Thermistors TH1, TH2, and TH3 as one example of a temperature detecting element contact a sheet passing region (sheet passing) of the laser printer 100 on a side of the substrate 305, on which heat generating resistors are provided. Similarly, a safety element 212, such as a thermal switch or a thermal fuse, which is turned on when abnormal heat generation of the heater 300 occurs and the power supplied to the heater 300 is stopped, also contacts the sheet passing region.

Figure 3A:
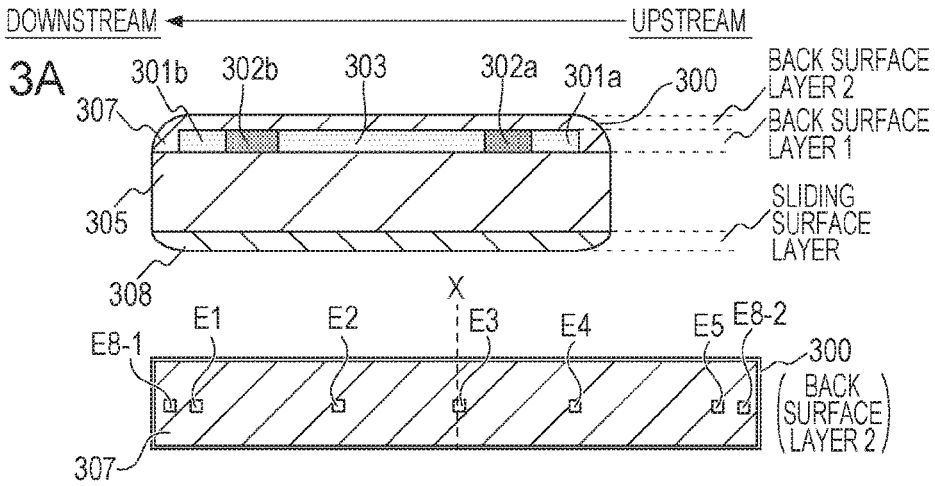
FIGS. 3A to 3C illustrate configurations of a heater according to the exemplary embodiment 1.

FIG. 3A is a cross-sectional view of the heater 300 taken along a widthwise direction. The heater 300 has a conductive element (second conductive element) 303 provided on the substrate 305 along the longitudinal direction of the heater 300. The heater 300 further has conductive elements 301*a* and 301*b* which are provided 305 along the longitudinal direction of the heater 300 and at a position different from that of the conductive element 303 in the widthwise direction of the heater 300 on the substrate. The conductive element (first conductive element) 301*a* is arranged on an upstream side in a conveying direction of the recording sheet P and the conductive element 301*b* is arranged on a downstream side therein. A conductive element 301 is used below when referring to both of the conductive element 301*a* and the conductive element 301*b*.

The heater 300 further has heat generating resistors (heat generating elements) 302*a* and 302*b*, each of which is provided between the conductive element 301 and the conductive element 303 and generates heat by power supplied via the conductive element 301 and the conductive element 303. The heat generating resistors 302*a* and 302*b* are heat generating materials having equal surface resistance (sheet resistance) per unit length. The heat generating resistor 302*a* is arranged on the upstream side in the conveying direction of the recording sheet P and the heat generating resistor 302*b* is arranged in the downstream side therein. A heat generating resistor 302 is used below when referring to both of the heat generating resistor 302*a* and the heat generating resistor 302*b*.

In a case where heat generation distribution of the heater 300 becomes asymmetry in the widthwise direction (conveying direction of the recording sheet P), stress exerted on the substrate 305 when the heater 300 generates heat increases. When the stress exerted on the substrate 305 increases, a crack occurs in the substrate 305 in some cases. Thus, the heat generating resistor 302 is divided into the heat generating resistor 302*a* arranged on the upstream side in the conveying direction and the heat generating resistor 302*b* arranged on the downstream side therein, so that the heat generation distribution of the heater 300 becomes symmetry in the widthwise direction. Note that, the heater 300 may have a configuration in which the heat generating resistor 302 is not divided into the upstream side and the downstream side.

A surface protection layer 307 (glass is used in the present exemplary embodiment) which covers the heat generating resistor 302, the conductive element 301, and the conductive element 303 and has insulation property is provided on a back surface layer 2 of the heater 300. Moreover, a surface protection layer 308 coated with sliding glass or polyimide is formed on a sliding surface (surface in contact with the film) layer 1 of the heater 300.

Figure 3B:
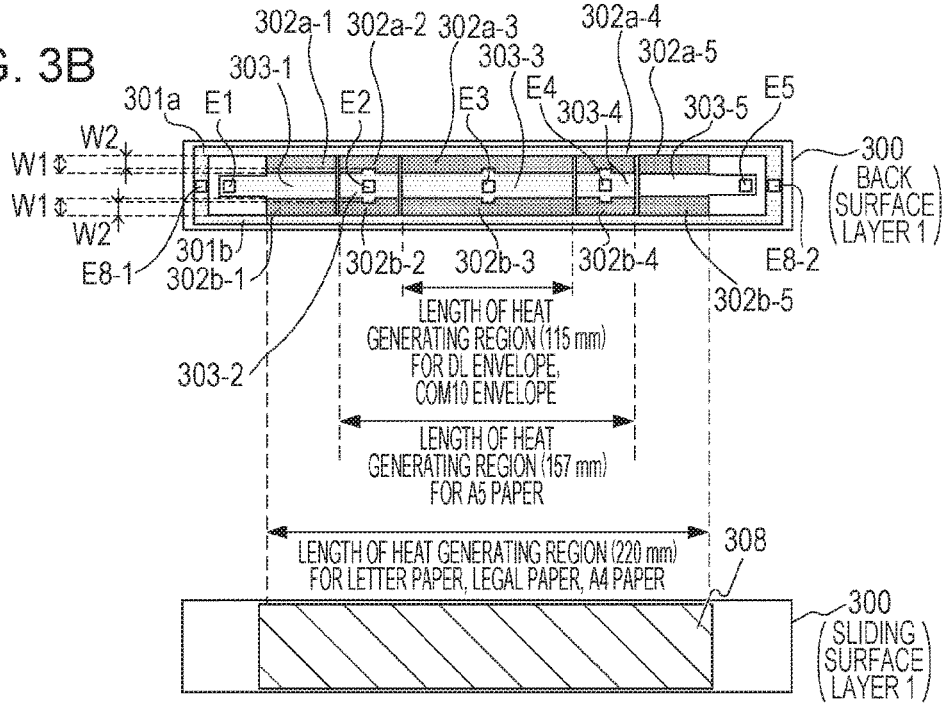

Next, a plan view of each layer of the heater 300 will be described with reference to FIG. 3B. The heater 300 has a plurality of heat generating blocks in the longitudinal direction of the heater 300. Each of the heat generating blocks is constituted by a set of the first conductive element 301, the second conductive element 303, and the heat generating resistor 302, and an electrode described below. The heater 300 of the present exemplary embodiment has five heat generating blocks in total at a center portion and both end portions of the heater 300 in the longitudinal direction.

The five heat generating blocks respectively have heat generating resistors 302*a*-1 to 302*a*-5 and heat generating resistors 302*b*-1 to 302*b*-5 which are formed in a symmetrical manner with the center of the heater 300 in the widthwise direction as a reference. A heat generating resistor 302-1 (or heat generating block 302-1) is used when referring to both of the heat generating resistors 302*a*-1 and 302*b*-1. Heat generating blocks 302-2 to 302-5 are used similarly. In addition, the conductive element 303 is also divided into five pieces of conductive elements 303-1 to 303-5. In the present exemplary embodiment, the recording sheet P is conveyed in the widthwise direction of the heater 300 with a conveyance reference position X as the center.

Thus, the dividing positions of the heat generating blocks are set so as to be divided in a symmetrical manner at positions corresponding to paper sizes. That is, the heat generating blocks 302-1 and 302-5 are arranged symmetrically with respect to a boundary of the reference position X and the heat generating blocks 302-2 and 302-4 are arranged symmetrically with respect to a boundary of the reference position X. Note that, in the device of the present exemplary embodiment, the reference position X also serves as a center of a heat generating region (an entire region from the heat generating block 302-1 to the heat generating block 302-5) in the heater longitudinal direction. In the present exemplary embodiment, when an image formed on a DL envelope or a COM 10 envelope is fixed, the heat generating block 302-3 generates heat. When an image formed on A5 paper is fixed, three blocks of the heat generating blocks 302-2 to 302-4 generate heat. When an image formed on Letter paper, Legal paper, or A4 paper is fixed, five blocks of the heat generating blocks 302-1 to 302-5 generate heat. Note that, the number of division and the dividing positions are not limited to five like in the present exemplary embodiment.

Electrodes E1 to E5 are electrodes for respectively supplying power to the heat generating blocks 302-1 to 302-5 via the conductive elements 303-1 to 303-5. Electrodes E8-1 and E8-2 are electrodes having different polarity from those of the electrodes E1 to E5. An electric contact for power feeding (not illustrated) (for example, a conductive member such as a cable) is connected to the electrodes. When voltage is applied to a portion between the conductive element 301 and the conductive element 303, current flows through the heat generating resistor along a sheet conveying direction.

The surface protection layer 307 which is a back side surface layer 2 of the heater 300 is formed other than portions of the electrodes E1 to E5, E8-1, and E8-2, and is configured to allow electric connection of electric contacts to each electrode from the back surface side of the heater 300. Each of the electric contacts is electrically connected to each electrode with a method of biasing by a spring, welding, or the like. Each of the electric contacts is connected to the control circuit 400 of the heater 300 described below via a conductive material, such as a cable or a thin metal plate, provided between the stay 204 and the holding member 201.

Here, characteristics of the heat generating block 302 will be described. The electrodes E2 to E4 are arranged within a region of the heat generating block 302 in the heater longitudinal direction and overlap with a heat generating region in the heater longitudinal direction. Thus, heat of the heat generating block 302 is easily radiated via the electrodes E2 to E4. Peripheries of the electrodes E2 to E4 are easily affected by the heat radiation. Then, a heat generation amount of the heat generating region overlapping with the electrodes E2 to E4 is increased in the present exemplary embodiment. Specifically, as illustrated in FIG. 3B, compared to a width W1 in the heater widthwise direction of the heat generating resistor in the region not overlapping with the electrodes, a width W2 of the region overlapping with the electrodes is set to be narrower. Thereby, the heat generation amount of the region with the width W2 is set to be larger than the region with the width W1. The present exemplary embodiment has a configuration in which the width W2 is narrower than the width W1 by 10% so as to take balance between heat radiation and the heat generation.

Note that, the heat generation amount may be adjusted depending on factors such as thickness of the electrodes, a material of the electrodes, and heat radiation from electric contacts connected to the electrodes. For example, a heat generating block having a large amount of current has a contact configuration capable of withstanding larger current in some cases. In this case, a heat radiation amount becomes larger compared to a contact configuration for small current. A method for adjusting a heat generation amount is not limited to adjustment of widths of the heat generating resistors in the widthwise direction, and the heat generation amount may be adjusted, for example, according to thickness or materials of the heat generating resistors.

In this manner, by intentionally increasing heat generation of heat generating resistors of portions corresponding to electrodes, it is possible to reduce a temperature difference between a portion overlapping with each electrode and a portion not overlapping with each electrode in the same heat generating block.

Figure 3C:
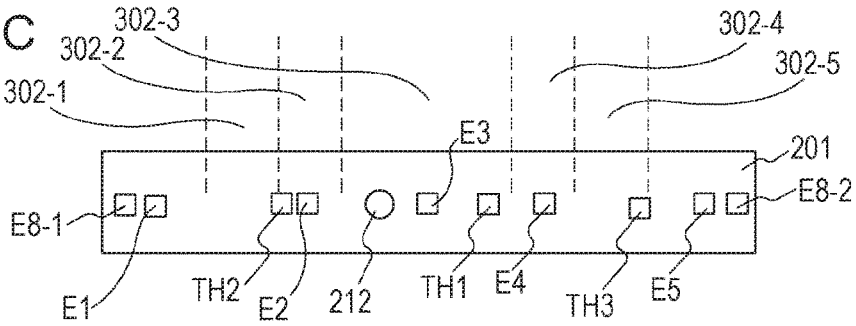

As illustrated in FIG. 3C, the holding member 201 of the heater 300 has holes formed for the thermistors (temperature detecting elements) TH1, TH2, and TH3, the safety element 212, and electric contacts for the electrodes E1 to E5, E8-1, and E8-2. Between the stay 204 and the holding member 201, the thermistors (temperature detecting elements) TH1, TH2, and TH3, the safety element 212, and the electric contacts in contact with the electrodes E1 to E5, E8-1, and E8-2 are provided. In the present exemplary embodiment, the thermistor TH1 is arranged at a position to detect temperature of the heat generating block 302-3 and the thermistor TH2 is arranged at a position to detect temperature of the heat generating block 302-2. The thermistor TH3 is at a position to detect temperature of the heat generating block 302-5.

Figure 4:
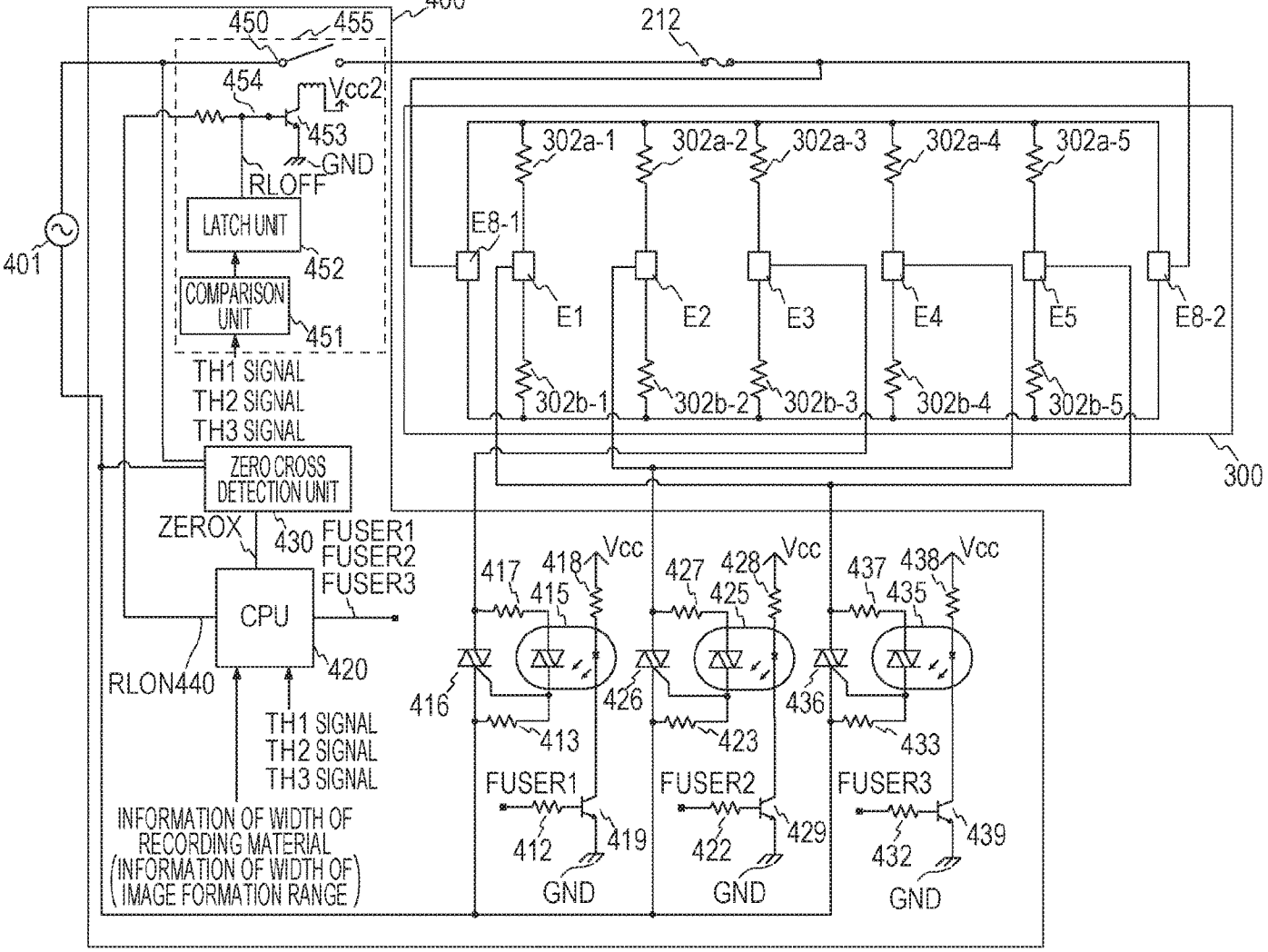
FIG. 4 illustrates a control circuit of the heater according to the exemplary embodiment 1.

FIG. 4 is a circuit diagram of the control circuit 400 of the exemplary embodiment 1. The reference numeral 401 denotes a commercial alternating current power supply connected to the laser printer 100. The alternating current power supply 401 is connected to the electrodes E8-1 and E8-2 of the heater 300 via a relay 450 and the safety element 212. The electrodes E1 to E5 are connected to triacs 416, 426, and 436 which are driving units (driving element). By controlling the triacs 416, 426, and 436, heat generation of the heat generating resistor 302 is controlled. The electrode E3 is connected to the triac 416 and heat generation of the heat generating block 302-3 is controlled by controlling the triac 416. The electrodes E2 and E4 arranged symmetrically with respect to a boundary of the conveyance reference position X which is a reference position of the recording sheet P when the recording sheet P is conveyed are connected to the triac 426 (first driving element). By controlling the triac 426, heat generation of the heat generating blocks 302-2 (second heat generating block) and 302-4 (third heat generating block) is controlled. The heat generating blocks

302-2 and 302-4 form a heat generating block group driven by one triac 426. Similarly, the electrode E1 and E5 arranged symmetrically with respect to a boundary of the conveyance reference position X are connected to the triac 436 (second driving element). By controlling the triac 436, heat generation of the heat generating blocks 302-1 (first heat generating block) and 302-5 (fourth heat generating block) is controlled. The heat generating blocks 302-1 and 302-5 form a heat generating block group driven by one triac 436.

Here, arrangement of thermistors (temperature detecting elements) will be described. In a heater having a plurality of heat generating blocks in a longitudinal direction, temperature of each of the heat generating blocks is desired to be directly monitored in order to monitor abnormal heat generation of the heater. Thus, a thermistor which is a temperature detecting element needs to be arranged in each of the heat generating blocks.

To arrange the thermistor (thermistor unit), however, a space in which not only the thermistor but also a member for supporting the thermistor, a spring for biasing the thermistor against the heater, a cable connected to the thermistor, and the like are arranged is required. When the thermistor is arranged for all the five heat generating blocks, a larger space for arranging these members is required. Since a size of a space surrounded by the stay 204 and the holding member 201 is limited, five thermistor units are difficult to be arranged. In this manner, when the heat generating block is segmented, there is an advantage that a much more sizes of sheets can be handled, but there is a problem that it is difficult to ensure a space for arranging the thermistors.

Figure 7:
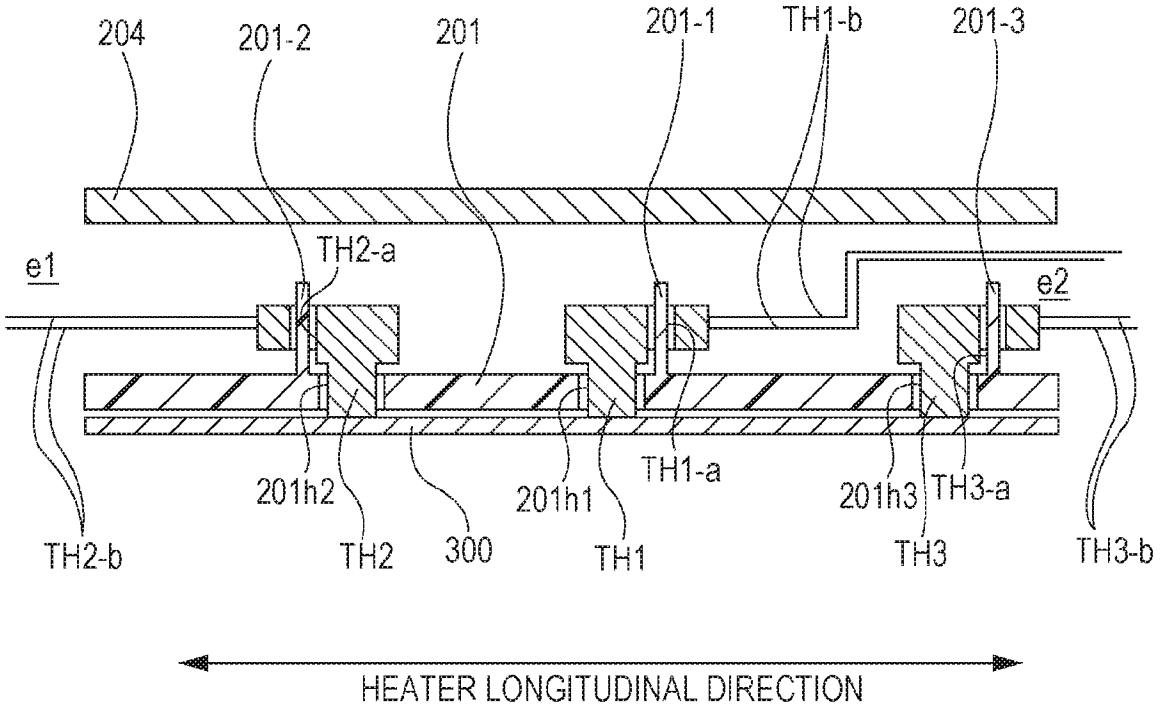
FIG. 7 illustrates a layout of thermistors in an image heating device.

FIG. 7 is a side view illustrating the holding member 201 and the stay 204 and a space therebetween for explaining arrangement of thermistors and wiring directions of cables. The holding member 201 holding the heater 300 is provided with shafts 201-1, 201-2, and 201-3 which hold the thermistors TH1 to TH3. The thermistors TH1 to TH3 are respectively provided with holes TH1-*a*, TH2-*a*, and TH3-*a* into which the shafts 201-1, 201-2, and 201-3 are inserted. The positions of the thermistors TH1 to TH3 are determined depending on the shafts 201-1, 201-2, and 201-3 and the holes TH1-*a*, TH2-*a*, and TH3-*a*. The thermistors TH1 to TH3 are biased against the heater 300 by a spring (not illustrated). The reference numerals TH1-*b*, TH2-*b*, and TH3-*b* denote cables connected to the thermistors TH1 to TH3. The reference numerals 201*h*1 to 201*h*3 denote holes provided in the holding member 201 for arranging the thermistors TH1 to TH3. Note that, in addition to the holes into which the thermistors are inserted, the holding member 201 also has holes used for the safety element 212, and the electric contacts for the electrodes E1 to E5, E8-1, and E8-2 as illustrated in FIG. 3C. The holes and elements are omitted in FIG. 7.

Meanwhile, as described above, the heat generating blocks 302-2 and 302-4 forming the heat generating block group is configured to be driven by the triac 426. In a case where the triac 426 does not operate normally to cause failure that power is continuously supplied to the heater 300, both of the heat generating blocks 302-2 and 302-4 continue to generate heat. That is, the heat generating blocks 302-2 and 302-4 always operate in a synchronous manner. Thus, when a thermistor is arranged only in any one of the heat generating blocks 302-2 and 302-4, temperatures of both of them are able to be substantially monitored by this thermistor. Similarly, a thermistor is only required to be arranged in any one of the heat generating blocks 302-1 and 302-5 forming the heat generating block group.

Thus, in the fixing device of the present exemplary embodiment, as illustrated in FIG. 3C, the thermistor TH2 (first temperature detecting element) corresponding to the heat generating block group (referred to as a first heat generating block group here) which has the heat generating blocks 302-2 (second heat generating block) and 302-4 (third heat generating block) is arranged in the heat generating block 302-2 (second heat generating block). Further, the thermistor TH3 (second temperature detecting element) corresponding to the heat generating block group (referred to as a second heat generating block group here) which has the heat generating blocks 302-1 (first heat generating block) and 302-5 (fourth heat generating block) is arranged in the heat generating block 302-5 (fourth heat generating block). No thermistor is provided in the heat generating block 302-1 (first heat generating block) and the heat generating block 302-4 (third heat generating block).

The first heat generating block group and the second heat generating block group have a relationship of being adjacent to each other. In the device of the present exemplary embodiment, thermistors are arranged so that the thermistors arranged in each of the adjacent heat generating blocks are not arranged in two heat generating blocks having a relationship of being adjacent to each other.

Specifically, the heat generating block adjacent to the heat generating block 302-2 (second heat generating block) in which the thermistor TH2 which is the thermistor of the first heat generating block group is the heat generating block 302-1 (first heat generating block) when the heat generating block 302-3 is excluded. The heat generating block 302-1 (first heat generating block) is the heat generating block of the second heat generating block group, and the thermistor TH3 of the second heat generating block group is arranged not in the heat generating block 302-1 (first heat generating block) but in the heat generating block 302-5 (fourth heat generating block) which is not adjacent to the heat generating block 302-2 (second heat generating block). Such a configuration makes it possible to prevent a plurality of thermistors from being concentratedly arranged at one portion and to ensure a space in which the plurality of thermistors are arranged. Further, since a plurality of holes (201*h* to 201*h*3) provided in the holding member 201 and used for arranging the plurality of thermistors are not concentrated at one portion, it is possible to suppress reduction of rigidity of the holding member 201.

As illustrated in FIG. 7, the cables connected to the thermistors TH2 and TH3 are respectively arranged to extend outside from one end e1 and the other end e2 in an internal space surrounded by the stay 204 and the holding member 201. Specifically, the cable TH2-*b* of the thermistor TH2 is brought out of the internal space from the end e1 and the cable TH3-*b* of the thermistor TH3 is brought out of the internal space from the end e2 opposite to the end e1. Since the cables are brought out separately from the end e1 and the end e2 in this manner, the internal space is not required to be made wider more than necessary compared to a configuration in which all cables of all thermistors are brought out from only one end. Thus, it is possible to prevent an increase in a size of the device. Note that, the cable TH1-*b* of the thermistor TH1 may be brought out from any of the ends e1 and e2.

The device of the present exemplary embodiment adopting a contrivance to reduce the number of the thermistors, contrivance for arrangement of the thermistors, and a contrivance for directions in which the cables are brought out further exerts effects when the number of division of heat generating blocks is increased.

Next, an operation of the triac 416 will be described. Resistors 413 and 417 are bias resistors for driving the triac 416. A phototriac coupler 415 is a device for maintaining a creepage distance between primary and secondary circuits. The triac 416 is turned on when a light emitting diode of the phototriac coupler 415 is energized. A resistor 418 is a resistor for limiting current flowing through the light emitting diode of the phototriac coupler 415 from a power supply voltage Vcc. The phototriac coupler 415 is turned on/off by a transistor 419. The transistor 419 operates according to a FUSER1 signal from the CPU 420. Circuit operations of the triacs 426 and 436 are the same as that of the triac 416, so that description thereof will be omitted.

The relay 450 is used as a power stopping unit configured to stop power supply to the heater 300 with outputs from the thermistors TH1, TH2, and TH3 when abnormal heat generation occurs in the heater 300 due to failure or the like. When a RLON440 signal output from the CPU 420 enters a high state, a transistor 453 is turned on, a secondary coil of the relay 450 is energized from a power supply voltage Vcc2, and a primary contact of the relay 450 enters an on state. When the RLON440 signal enters a low state, the transistor 453 is turned off, the current flowing through the secondary coil of the relay 450 from the power supply voltage Vcc2 is stopped, and the primary contact of the relay 450 enters a stop state.

Next, an operation of a protection circuit 455 using the relay 450 will be described. When any one of detected temperatures of the thermistors TH1, TH2, and TH3 is over a predetermined temperature which is set for each of them, a comparison unit 451 operates a latch unit 452 to latch a RLOFF signal in a low state. When the RLOFF signal enters the low state, the off state of the transistor 453 is maintained even when the CPU 420 causes the RLON440 signal to enter the high state, so that the stop state of the relay 450 is maintained. When the detected temperatures of the thermistors TH1, TH2, and TH3 are not over the predetermined value which is set for each of them, the RLOFF signal of the latch unit 452 enters an open state. Thus, when the CPU 420 causes the RLON440 signal to enter the high state, the relay 450 is energized so that power is able to be supplied to the heater 300.

A zero crossing detection unit 430 is a circuit for detecting zero crossing of the alternating current power supply 401 and outputs a ZEROX signal to the CPU 420. The ZEROX signal is used for controlling the heater 300.

Next, a method for controlling the temperature of the heater 300 will be described. The temperature of the heater 300 is detected by the thermistor TH1 and input to the CPU 420 as a TH1 signal. The temperatures of the thermistors TH2 and TH 3 are detected by the CPU 420 in a similar manner. With internal processing of the CPU (controller) 420, the power to be supplied is calculated, for example, through PI control based on the temperature detected by the thermistor TH1 and the temperature set to the heater 300. Further, the CPU 420 converts the power to a control level of a phase angle (phase control) or a wave number (wave number control), which corresponds to the power to be supplied, and controls the triacs 416 and 436 according to the control condition thereof. The temperature control for the heater 300 is performed based on the temperature of the heater 300 detected by the thermistor TH1 in the present exemplary embodiment. Note that, temperature of the film 202 may be detected by a thermistor or a thermopile, and temperature control for the heater 300 may be performed based on the detected temperature.

Figure 5:
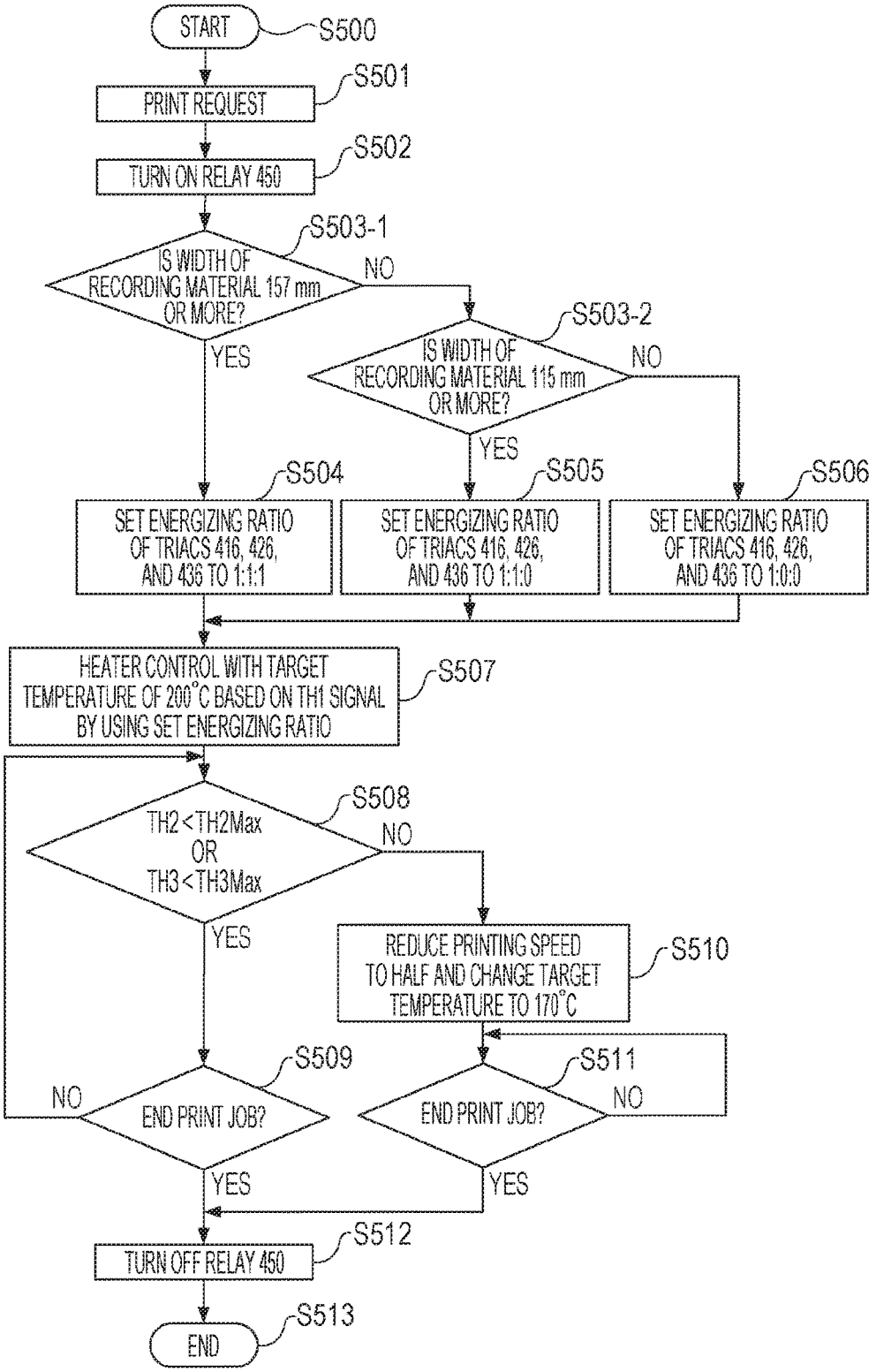
FIG. 5 is a flowchart illustrating control according to the exemplary embodiment 1.

FIG. 5 is a flowchart for explaining a control sequence of the image heating device 200 by the CPU 420. When a print request is generated at S501, the relay 450 is turned on at S502. Subsequently, whether the width of a recording material is 157 mm or more is judged at S503-1.

The laser printer 100 of the present exemplary embodiment shits to S504 in the case of Letter paper, Legal paper, A4 paper, and non-standardized paper fed from the sheet feed tray 28 and having a width of 220 mm or more. Then, the energizing ratio of the triacs 416, 426, and 436 is set to 1:1:1.

When the width of the recording material is 157 mm or less, the procedure shifts to S503-2 to judge whether the width of the recording material is 115 mm or more. In the present exemplary embodiment, the procedure shifts to S505 in the case of corresponding to A5 paper. Then, the energizing ratio of the triacs 416, 426, and 436 is set to 1:1:0.

Further, when the width of the recording material is 115 mm or less, the recording material corresponds to a DL envelope or a COM10 envelope, and the procedure shifts to S506. Then, the energizing ratio of the triacs 416, 426, and 436 is set to 1:0:0.

Note that, a method for judging the width of the recording material at S503-1 and S503-2 may be any method and examples thereof include a method using a paper-width sensor provided in the sheet supplying cassette 11 or the sheet feed tray 28 and a method using a sensor such as a flag provided in a conveying path for the recording material P. Other examples thereof include a method based on width information of the recording material P set by a user and a method based on image information for performing image formation on the recording material P.

At S507, an image formation process speed is set to full speed by using the set energizing ratio, and fixing processing is performed while temperature control is performed so that the detected temperature of the thermistor TH1 is maintained at a target set temperature of 200° C.

Whether to be over a maximum temperature TH2Max of the thermistor TH2 or a maximum temperature TH3Max of the thermistor TH3, each of which is set to the CPU 420, is judged at S508. When it is detected based on the thermistor signals TH2 and TH3 that temperature rise in a sheet non-passing portion easily occurs and the temperature of an end of a heat generating region is over the predetermined upper limit, the procedure shifts to S510. Then, the image formation process speed is set to half speed, and fixing processing is performed while temperature control is performed so that the detected temperature of the thermistor TH1 is maintained at a target set temperature of 170° C. The fixing processing is continued with the state of S510 until end of a print job is detected at S511. When the image formation process speed is set to half, fixability is able to be obtained even with a lower temperature compared to the case of full speed, thus making it possible to reduce a fixing target temperature and also to suppress temperature of the sheet non-passing portion. When the temperature of each of the thermistors does not exceed the maximum temperature at S508, the procedure shifts to S509. At S509, the fixing processing is continued by shifting to S507 until the print job ends.

The aforementioned processing is repeated, and when end of the print job is detected at S509 and S511, the relay 440 is turned off at S512 and the control sequence for image formation ends at S513.

As described above, a heat generation amount of a heat generating resistor corresponding to a region with which an electrode unit in a heat generating block overlaps is set to be higher than that of a portion of other heat generating resistors in the same heat generating block. Thereby, it is possible to reduce influence of heat radiation at the electrode unit and form more uniform temperature distribution in the heater longitudinal direction.

(Exemplary Embodiment 2)

A heater 600 in which arrangement of electrodes in a heat generating region is considered will be described in the present exemplary embodiment. The same reference signs will be assigned to similar configurations to those of the exemplary embodiment 1 and description thereof will be omitted.

Figure 6A:
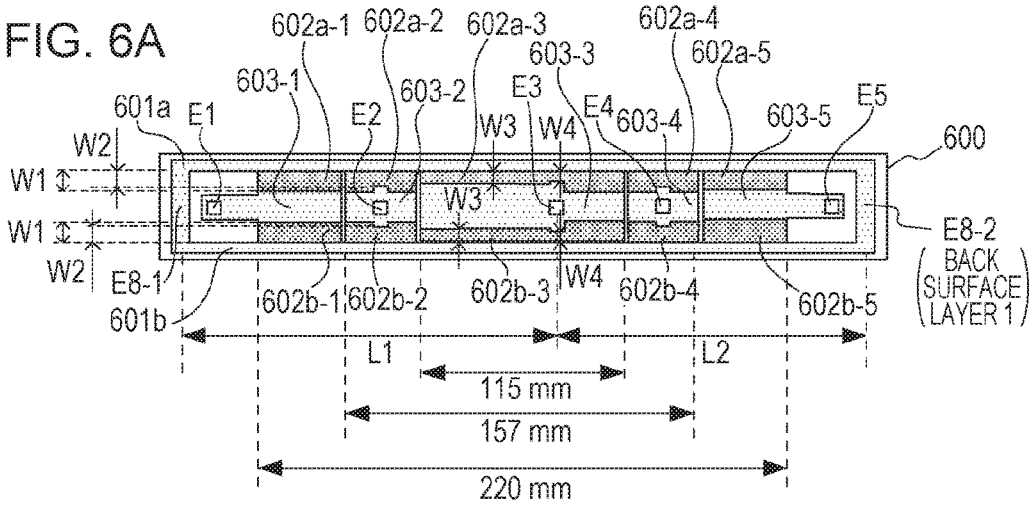
FIGS. 6A to 6C illustrate configurations of a heater according to an exemplary embodiment 2.
Figure 6B:
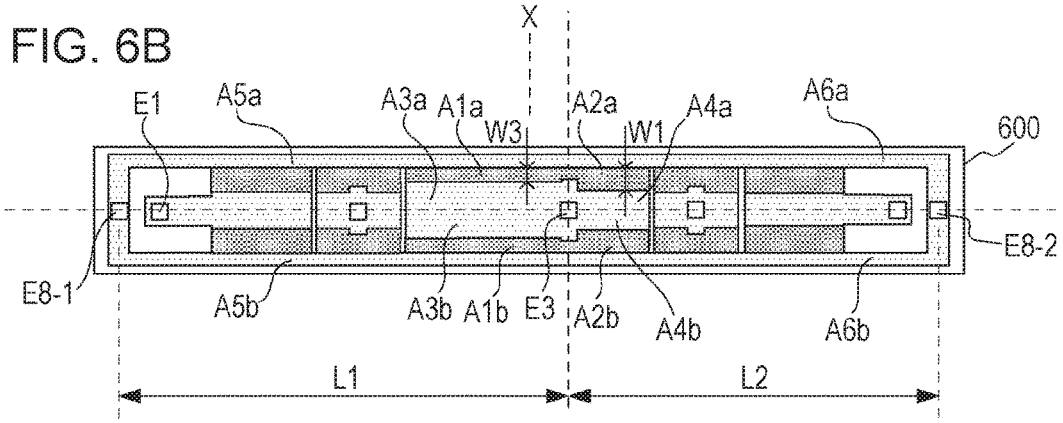
Figure 6C:
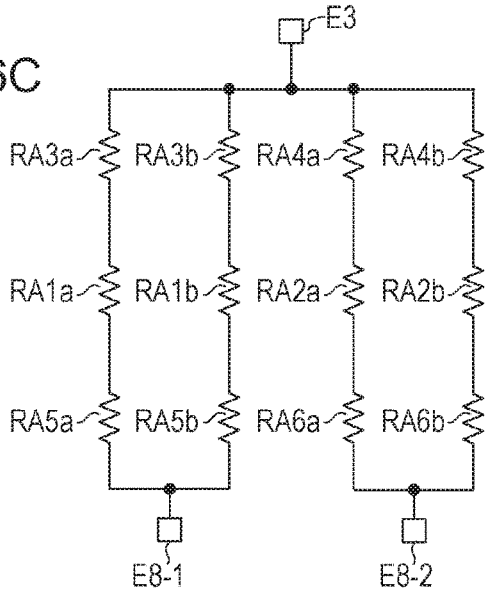

FIGS. 6A to 6C illustrate the heater 600 in the present exemplary embodiment. As illustrated in FIG. 6A, the electrode E3 is arranged to have lengths L1 and L2 from the electrode E8-1 and the electrode E8-2, respectively. The lengths L1 and L2 are not always set to be the same, and may be set to be different depending on, for example, arrangement of thermistors and the safety element 212. There is a relationship of the length L1>the length L2 in the heater 600.

A current path from the electrode E3 to the electrode E8-1 and the electrode E8-2 will be described with reference to FIG. 6B. Here, description will be given by dividing a heat generating block 602-3 of FIG. 6A into four areas with the electrode E3 as the center. That is, a conductive element 601 illustrated in FIG. 6A is divided into four areas of A5*a*, A5*b*, A6*a*, and A6*b* as illustrated in FIG. 6B for convenience. A heat generating resistor of the heat generating block 602-3 is divided into areas of Ala, A1*b*, A2*a*, and A2*b*, and the conductive element 603-3 is divided into areas of A3*a*, A3*b*, A4*a*, and A4*b*. The current path is formed in four directions from the electrode E3 to the electrodes E8-1 and E8-2. The current path connecting the electrodes E3 and E8-1 includes resistance components of the areas A3*a* and A3*b* of the conductive element 603-3, the areas A1*a* and A1*b* of the heat generating resistor, and the areas A5*a* and A5*b* of the conductive element 601. On the other hand, the current path connecting the electrode E3 and the electrode E8-2 includes resistance components of the areas A4*a* and A4*b* of the conductive element 603-3, the areas A2*a* and A2*b* of the heat generating resistor, and the areas A6*a* and A6*b* of the conductive element 601.

FIG. 6C illustrates an equivalent circuit of the heater 600. In the present exemplary embodiment, since there is a relationship of the length L1>the length L2, a resistance value of the conductive element of the current path connecting the electrodes E3 and E8-1 is higher than that of the current path connecting the electrodes E3 and E8-2. A difference between the resistance values causes a difference of voltage drops, which results in a difference of heat generation amounts between the areas A1*a* and A1*b* and the areas A2*a* and A2*b*. Thereby, the temperature of the areas A1*a* and A1*b* becomes lower than that of the areas A2*a* and A2*b*.

Thus, it is set so that the areas A1*a* and A1*b* in the current path extending from the electrode E3 to the electrode E8-1 has a larger heat generation amount than the areas A2*a* and A2*b*. Specifically, a width W3 of the heat generating resistor in the heater widthwise direction in the areas A1*a* and A1*b* is set to be shorter than a width W1 of the heat generating resistor in the areas A2*a* and A2*b*. As the width of the heat generating resistor in the heater widthwise direction is shorter, the heat generation amount becomes greater.

On the other hand, since the electrodes E2 and E4 are placed symmetrically with respect to the conveyance reference position (center in the heater longitudinal direction) X, without providing a difference of the widths W1 and W3, a magnitude of the heat generation amount of a heat generating block 602-2 and a magnitude of the heat generation amount of a heat generating block 602-4 are the same. A magnitude of the heat generation amount of a heat generating block 602-1 and a magnitude of the heat generation amount of a heat generating block 602-5 are also the same without providing a difference of the widths W1 and W3. Note that, the width W4 of a high heat generating region corresponding to the electrode E3 is narrower than the width W3.

As described above, in a configuration in which there is a deviation in resistance values of conductive elements on a current path due to the position of the electrode E3, imbalance of heat generation amounts may be adjusted by providing a difference between resistance values of heat generating resistors. This makes it possible to provide a heater generating heat more uniformly without being influenced by a difference of voltage drops.

While the invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-179568, filed on Sep. 11, 2015, and Japanese Patent Application No. 2016-138756, filed on Jul. 13, 2016, which are hereby incorporated by reference herein in their entirety.

What is claimed is:

1. A heater used for an image heating device, the heater comprising:

a substrate;

a first conductive element provided on the substrate along a longitudinal direction of the substrate;

a second conductive element provided at a position different from that of the first conductive element of the substrate in a widthwise direction of the substrate perpendicular to the longitudinal direction;

a heat generating element which is provided between the first conductive element and the second conductive element and generates heat with power supplied via the first conductive element and the second conductive element; and an electrode for suppling power to the heat generating element, the electrode being provided on the second conductive element, wherein a width in a widthwise direction of the heat generating element overlapping with the electrode in the longitudinal direction is narrower than that of other regions of the heat generating element in the longitudinal direction, and wherein a heat generation amount of a region of the heat generating element overlapping with the electrode in the longitudinal direction is set to be greater than a heat generation amount of other regions of the heat generating element in the longitudinal direction.

2. The heater according to claim 1, wherein the electrode is provided within a region in which the heat generating element is provided in the longitudinal direction.

3. The heater according to claim 1, wherein the heater has a plurality of heat generating blocks in the longitudinal direction, each of which is constituted by a set of the first conductive element, the second conductive element, the heat generating element, and the electrode.

4. An image heating device, comprising:

a cylindrical film; and a heater in contact with an inner surface of the film, wherein an image formed on a recording material is heated with heat of the heater via the film, and wherein the heater is the heater according to claim 1.

* * * * *